US008250991B2

(12) United States Patent
Brandt

(10) Patent No.: US 8,250,991 B2
(45) Date of Patent: Aug. 28, 2012

(54) AUTOMATED RAILCAR GATE OPERATING SYSTEM

(75) Inventor: Calvin J. Brandt, Delano, MN (US)

(73) Assignee: Calbrandt, Inc., Delano, MN (US)

( * ) Notice: Subject to any disclaimer, the term of this patent is extended or adjusted under 35 U.S.C. 154(b) by 157 days.

(21) Appl. No.: 12/696,229

(22) Filed: Jan. 29, 2010

(65) Prior Publication Data

US 2011/0185940 A1 Aug. 4, 2011

(51) Int. Cl.
*B61D 5/00* (2006.01)

(52) U.S. Cl. ..... 105/241.2

(58) Field of Classification Search ..... 105/238.1, 105/241.1, 241.2, 286–288; 73/865.8, 865.9, 73/866.1

See application file for complete search history.

(56) References Cited

U.S. PATENT DOCUMENTS

| | | | | |
|---|---|---|---|---|
| 6,886,473 | B2 * | 5/2005 | Marchiori et al. | 105/241.2 |
| 7,063,022 | B1 | 6/2006 | Marchiori et al. | |
| 7,178,465 | B1 | 2/2007 | Marchiori et al. | |
| 7,328,871 | B2 * | 2/2008 | Mace et al. | 246/169 R |
| 7,377,219 | B2 * | 5/2008 | Brandt | 104/162 |
| 7,755,660 | B2 * | 7/2010 | Nejikovsky et al. | 348/143 |
| 2006/0012183 | A1 * | 1/2006 | Marchiori et al. | 292/63 |
| 2010/0253329 | A1 * | 10/2010 | Arcaini et al. | 324/217 |

* cited by examiner

*Primary Examiner* — S. Joseph Morano
*Assistant Examiner* — R. J. McCarry, Jr.
(74) *Attorney, Agent, or Firm* — Nikolai & Mersereau, P.A.; C. G. Mersereau

(57) ABSTRACT

An automated trackside railed car discharge gate operating system is disclosed which can automatically unload a string of cars "on the fly" and without the need for a separate indexing system. The system includes a pair of carriage-mounted tool systems for opening/closing capstan-operated railcar gates disposed to travel along a carriage track and including visual devices that acquire and track capstans and coordinate tool orientation and operation.

7 Claims, 3 Drawing Sheets

AUTOMATED RAILCAR GATE OPERATING SYSTEM

CROSS-REFERENCED TO RELATED APPLICATIONS

Not applicable

STATEMENT REGARDING FEDERALLY SPONSORED RESEARCH OR DEVELOPMENT

Not applicable

BACKGROUND OF THE INVENTION

I. Field of the Invention

The present invention relates generally to an automated system for opening and closing bottom gates on railcars and, more particularly, relates to an automated railcar gate operating system for capstan-operated railcar gates that sequentially locates and opens and closes gate operating capstans of railcars on the fly as the car move along across a cargo receiving pit.

II. Related Art

Uni-Trains, many containing 100 or more cars of identical or a variety of sizes and types, have long been acknowledged as desirable and efficient carriers of bulk raw materials such as coal, iron ore, limestone, various finely divided dry bulk agricultural products including grains, etc., and liquid or dry chemicals. These cars are typically filled from above and may be emptied using a rotary car dumper in the case of coal or iron ore. Liquid bulk cargo is typically unloaded by connecting outlets to large hoses with associated pumping equipment and opening bottom drain valves.

Cars shipping bulk agricultural products, for example, however, are bottom emptied into stationary cargo-receiving pits. These cars are provided with a number of spaced bottom discharging hopper bins accessing the main storage volume of the car. These hoppers are closed by horizontal slide gates. When the hoppers are precisely positioned over fixed recessed receiving facilities beneath the railroad track, the gates are opened and the cargo discharged.

In the bottom discharge operation, a connected train engine roughly positions one end of a string of cars to be unloaded close to the unloading facility. However, train engines are not well suited for indexing or precisely positioning individual cars or even sets of cars along the track. Because of this, traditionally, train positioning devices known as railroad car indexers or movers have been built and operated at fixed stations along the tracks to more precisely position cars for unloading operations.

Railroad cars having bottom discharge hopper-type bodies include spaced aligned hoppers which are closed by separate, horizontally disposed gates that are displaced laterally to open and close the bottom of each hopper by drive systems that typically include a rack and pinion mechanism operated by rotating an associated operating rod using an attached capstan. This requires a separate manual operation utilizing a powered gate operator in which a key or gripper device is used to attach to and rotate each of the capstans. This function has long involved the provision of a separately supplied cantilevered gate operator device utilizing a telescoping chuck to engage a capstan of a railroad car gate. The gate operators are typically separately mounted to operate along their own gate operator platform spaced from, but associated with, a railcar indexing system. This has involved a relatively slow and labor intensive operation. The chuck must be adjusted to match the height, depth and rotational position of each capstan.

Attempts have been made to automate the opening and closing of railcar discharge doors using trackside devices mounted on moveable carriages to operate doors located near the bottom of hopper-type railcars. One such system used to address latching, hinged gates is shown in U.S. Pat. Nos. 7,063,022 and 7,178,465. Earlier attempts to automate capstan operators have heretofore not met with much success.

Thus, there remains a need to provide a fully automated bottom discharge gate operating system that addresses rotating capstan-operated bottom discharge gates in commodity carrying railcars. Such a system would be particularly advantageous if it could operate to unload a string of cars into a grain receiving pit "on the fly" while the cars are moved across the pit.

SUMMARY OF THE INVENTION

By means of the present invention, there is provided an automated trackside railcar discharge gate operating system which can automatically unload a string of cars "on the fly" and without the need for a separate indexing system. The system includes a pair of carriage-mounted tool systems for opening/closing capstan-operated railcar gates disposed to travel along a carriage track and including visual devices to acquire and track capstans to coordinate tool operation. In one embodiment, for unloading cars in adjoining consecutive receiving pits, a pair of spaced fixed-positioned camera devices are situated along the track for sequentially acquiring and transmitting coordinates of passing railcar gate capstans to the carriage-mounted tool systems. A railcar location feedback system in communication with the fixed camera devices is provided for communicating railcar positions to the fixed-position camera devices. The feedback system includes a plurality of carriage-mounted devices with deployable bogey frame engaging arms that are pushed along by the railcars as they are processed.

Each of the visual devices associated with carriage-mounted tool systems includes a video camera with three-dimensional capability for recognizing and resolving both a capstan rotational position and lateral position distance and causing the tool system to track the capstan. Each of the tool systems also includes a means for aligning a capstan operating chuck tool with the recognized capstan rotational orientation for both the opening and closing steps which can be accomplished as the capstan continues to move.

DETAILED DESCRIPTION

The following description details one or more exemplary embodiments illustrating the present invention. It should be noted that the detailed descriptions are intended by way of example only and are not intended to limit the scope of the invention in any respect. It will be further understood that the embodiments of the invention can be modified by those skilled in the art while remaining in keeping with the inventive concepts.

Figure 3:
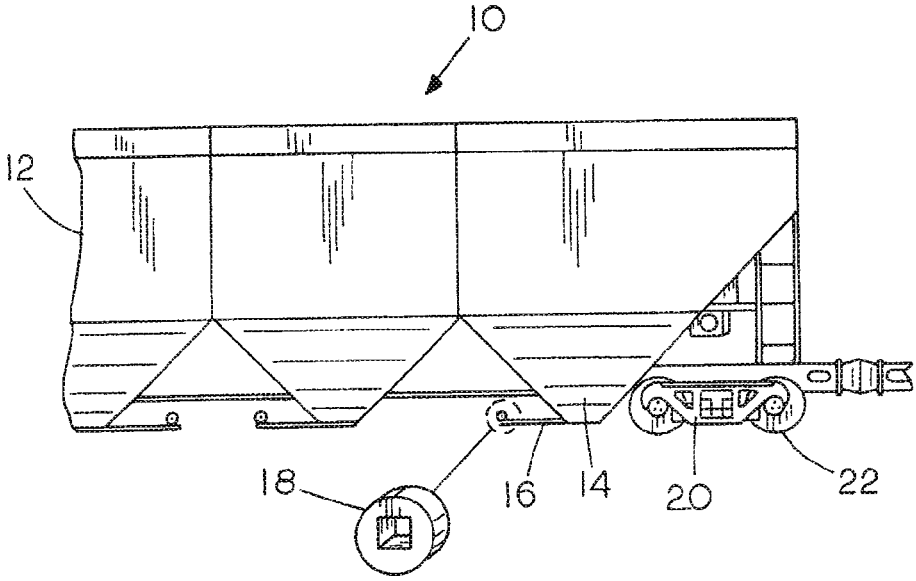
FIG. 3 is a fragmentary side elevational view of a railcar having discharge gates with which the present automated system is designed to be used.

FIG. 3 is a fragmentary view of a typical bulk cargo, bottom discharging railcar 10 of a class for which the automated trackside railcar discharge gate operating system of the present invention is designed. The car has a cargo hold 12, a plurality of discharge chutes as at 14, closed by rack and pinion operated gate members operated by rotating capstans, a portion of one of which is shown enlarged at 18. A bogey frame is shown at 20 with wheels 22.

Figure 1:
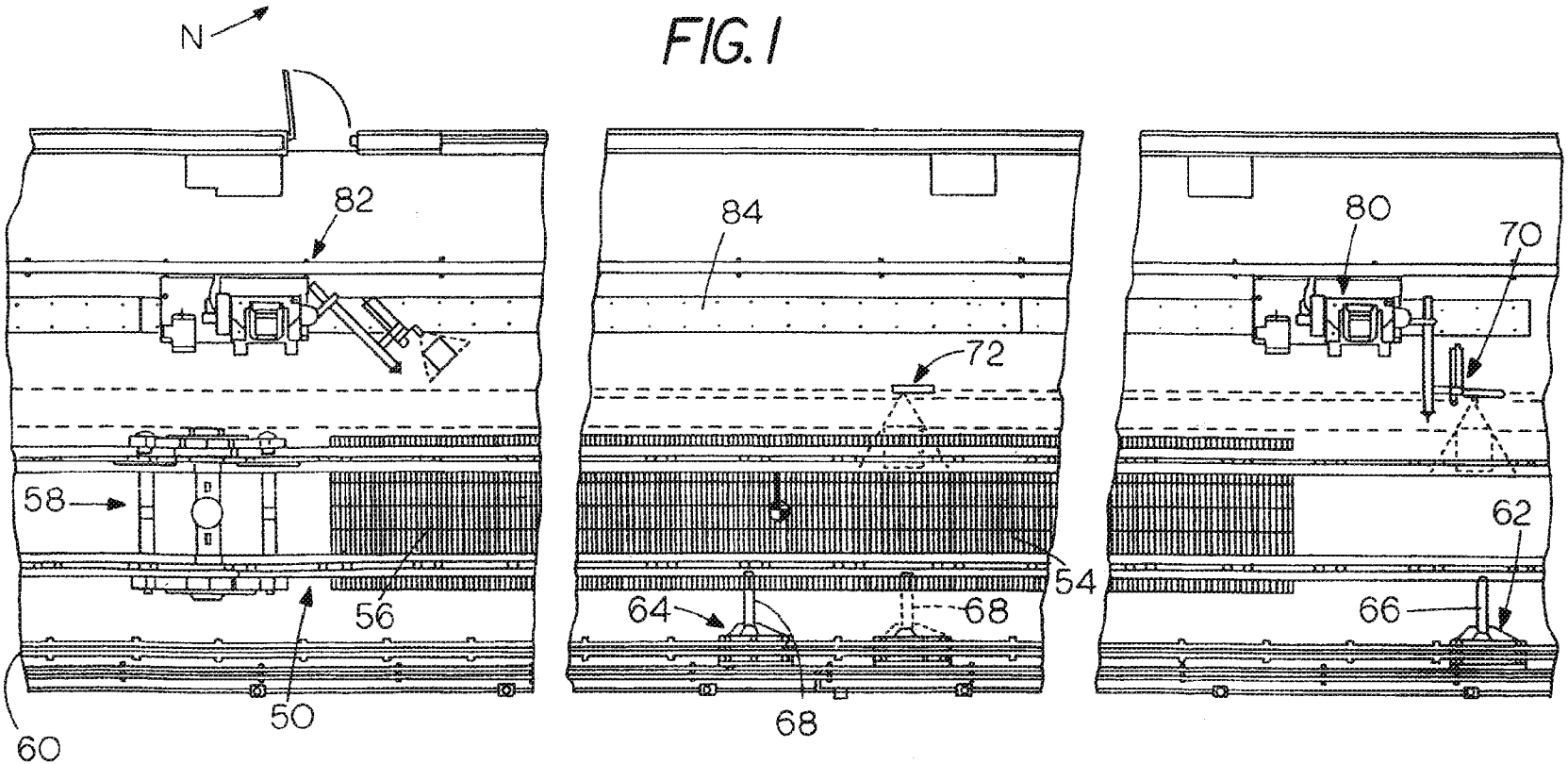
FIG. 1 is a plan layout of an automated trackside discharge gate-operating system in accordance with the invention with parts broken away for clarity.

A plan layout of an automated trackside discharge gate operating system in accordance with the invention is shown with parts broken away for clarity in FIG. 1, The general layout includes a main railroad track 50 that traverses over a cargo receiving area that is divided into north and south pit areas as at 54 and 56. A bogey frame is shown schematically at 58 for illustration purposes regarding railcar location, width, etc.

A gate operator feedback track 60 is located parallel to and spaced from the main track 50 on the side opposite that of the gate opening/closing system devices. The feedback track carries a plurality of feedback actuator devices, including a north actuator device 62 and a south actuator 64 (shown in two positions). For convenience, the direction north is designated as generally left to right in FIG. 1. Each actuator device includes a deployable arm as at 66 and 68 for north and south devices, respectively. The feedback track is spaced from the main track a distance that enables the actuator arms on the feedback devices to be contacted by the bogey frames of cars moving past the feedback devices when the arms are deployed. The feedback actuator devices further include motorized arm displaying actuators that rotat the corresponding arms in and out of the deployed position. The feedback actuators can be operated to move along the feedback track 60 , but are designed to be moved along by contacted bogey frames when the arms are deployed. Two fixed video camera devices, including a fixed gate-opener camera device 70 and a fixed gate-closer camera device 72, are mounted a distance apart along and feedback track location. These devices recognized and note the coordinates of passing capstans associated with railcar discharge gates and transmit this data to mechanzied carriage-mounted tool systems for opening and closing capstan-operated railcar discharge gates. These include a gate opener tool system shown generally at 80 and a gate closer tool system, generally at 82. The tool systems operate along a gate opener/closer track 84 located parallel to and spaced alongside the main track, just beyond the location of the fixed camera devices, so that the tool systems may operate to traverse and pass behind the fixed camera devices as necessary with the opener/closer tool stowed. The system 82 is shown with the tool in a rotated, stowed postion.

FIGS. 2A-2D depict views of a carriage-mounted tool system similar to those shown at 80 and 82 in FIG. 1 in accordance with the invention. The tool system includes an enclosed hydraulic power unit 100 that is used to power both the linear travel of the tool system as it traverses along the simulated gate opener/closer track as at 112 and indicated by the arrow 114 in FIG. 2A. The tool system includes a telescoping capstan operating tool 102 having an outer tube 104 containing an extendable rotating chuck member 106 of a shape and size matching that of the gate-operating capstans of interest. The chuck member is operated by a motor 110 coupled to a telescoping shaft carrying the chuck member 106. The motor is capable of sensing and adjusting the rotational position of the chuck member to match the observed rotational position of a corresponding capstan, as will be explained. The gate-operating tool stations further include a laser device 111 that indicates the relative extended position of the tool. A further tool actuator is provided (not shown) which combines tool extend/retract functions with tool pivot and rotation functions. Each gate-operating tool system further has a fixed 3D camera 108 mounted on the tool unit that verifies the exact location and orientation of each capstan entering its field of view to coordinate the operation of the tool with each capstan observed. One such camera that has been used successfully includes a CMOS chip optimized for 3D imaging using a laser and rapid data processing with triangulation and is available as a Smart Camera from SICK AG of Waldkirch, Germany.

Figure 2A:
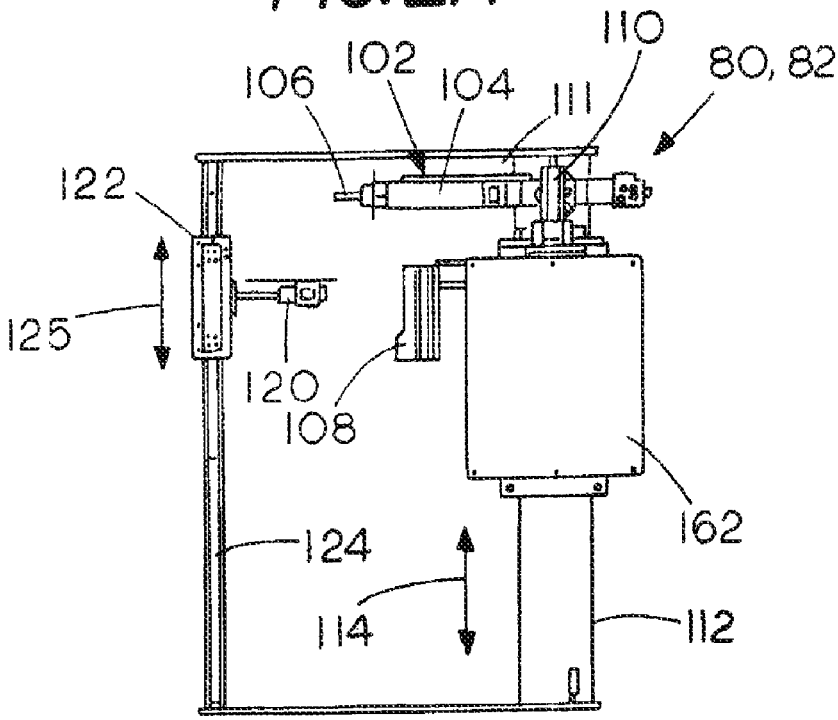
FIG. 2A is a top schematic view of a carriage-mounted tool system in accordance with the invention shown in relation to a normal capstan location.
Figure 2B:
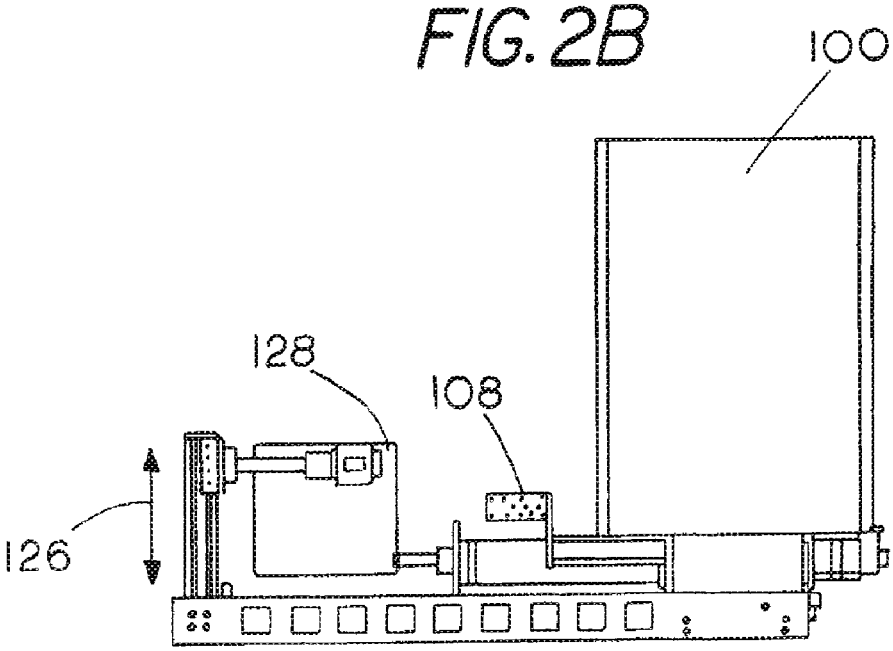
FIG. 2B is a side elevational view of the carriage-mounted tool system of FIG. 2A.
Figure 2C:
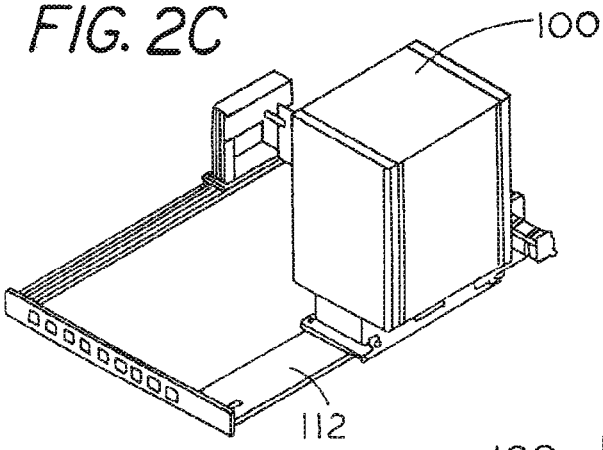
FIG. 2C is a rear perspective schematic view of the carriage-mounted tool system of FIG. 2A.
Figure 2D:
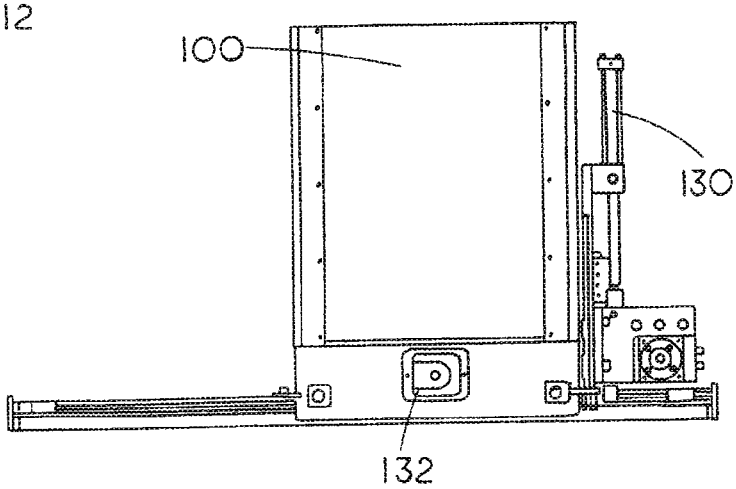
FIG. 2D is a schematic rear elevational view of the carriage-mounted tool system of FIGS. 2A-2C.

The figures further include a representation of a movable gate-operating capstan device at 120 mounted on a carriage 122 capable of traversing a track or guideway 124 or being raised and lowered as shown by arrows 125 and 126 and the location may be anywhere within, for example, box 128, shown in FIG. 2B. As shown best in FIG. 2D, a vertical cylinder 130 is provided to adjust the height of the tool in accordance with received coordinates. The tool 102 is also capable of swinging out of the way to a retracted position, as shown for system 82 in FIG. 1. A traverse drive access cover is shown at 132.

In operation, the carriage-mounted railcar gate opener/closer carriage assembly tool systems are operated in conjunction with the fixed camera devices and feedback system. A typical sequence of operations for the system is enumerated in the following list of steps:

To unload a string of cars, initially, with reference to the directions of FIG. 1, railcars are spotted using a locomotive such that the coupler between the first and second car is centered between the south pit 56 and north pit 54. The first two cars may be addressed and unloaded manually according to steps 2 and 3.

1. With two railcars over the pit area, the operator engages the north feedback device 62 to the south side of the south truck of the third car deploying the arm 66.

2. The operator manually opens and closes the north car with the railcar opener. Then the South car is manually opened and closed with the railcar closer. This also allows the operator to insure that the machines are in optimal operating condition.

3. The operator returns the machines to the start position.

4. With the first two cars empty and closed, the locomotive will begin moving cars south at a maximum speed of about 40 feet (12.2 m) per minute (8 inches or 20.3 cm per second).

5. The north feedback device 62 is pushed along by the third car providing pulses that are transmitted to the fixed camera 70.

6. The third railcar passes a car reader (provided by others) and the number of capstans along with the distance between trucks for the railcar is recorded.

7. When the fixed camera 70 recognizes a capstan square hole, the coordinates are sent to the railcar gate opener tool system 80.

8. The railcar gate opener tool system 80 traverses north while the railcars move south. It extends its vision camera while raising the tool to match the coordinates received from the fixed camera and scans the car as it moves by.

9. When the railcar opener dynamic camera recognizes a square hole in a capstan, it will track the capstan target and insert the tool.

10. The gate opener will first turn the capstan counterclockwise to open the gate. If the gate won't rotate open, it will be turned clockwise to open the gate until the motor stalls. While the gate opener is opening the gate, the fixed camera 60 has scanned and logged the coordinates of the next gate capstan.

11. If the current capstan is not the last capstan for that railcar, the gate opener retracts its tool and returns to step 7. If the current capstan is the last, then step 12 becomes active.

12. While the gate opener tool is inserted in the last gate after it is opened, the north feedback device will transfer. Using the distance between the trucks noted earlier from the database along with the then current position of the gate opener tool system 80, a position to again deploy the north feedback device 62 is calculated.

13. When the north feedback device 62 reaches the target position, it stops and deploys its arm 66. Then the gate opener retracts from the last capstan and moves rapidly north to the initial traverse position.

14. Step 6 becomes active. This process (steps 6-13) repeats until all cars are emptied.

During the unloading process, the gate closing operation is also underway and proceeds in the sequence described next.

1. The south feedback device 64 waits at its full north position. When the north feedback device is pushed to a location approximately 18 feet from the south by the third railcar, the south feedback arm 68 will deploy. In this manner, the arm 68 will make contact with the south side of the north truck of the third railcar.

2. The railcar gate closer tool system then traverses north while the railcars move south. It extends its vision camera while raising the tool to match the coordinates received earlier from the fixed camera 70 and scans the car as it moves by.

3. When the railcar gate closer tool system dynamic camera recognizes the square hole in the capstan, it will track the target and insert the tool.

4. The gate closer will turn the capstan to rotate in the opposite direction from that in which the gate was opened until the motor stalls.

5. If the then current capstan is not the last, the gate opener retracts its tool and returns to step 2. If the current capstan is the last of the current railcar, then step 6, below, becomes active. If the then current capstan is the last capstan of the last railcar, step 9 becomes active.

6. While the gate closer tool is inserted in the last gate after it is closed, the South feedback device 64 will transfer. Using the distance between the trucks noted earlier from the database along with the current position of the gate closer, a new position to deploy the south feedback device 64 is calculated.

7. When the south feedback device 64 reaches the new target position, it stops and deploys its arm 68. Meanwhile, the gate closer tool is retracted from the capstan and moves rapidly north to return to the initial traverse position.

8. Step 2 becomes active. This process sequence (steps 2-8) repeats until the closer inserts its tool into the last capstan of the second to last railcar.

9. With the opener inserted in the last capstan of the last railcar, the south feedback device 64 will stow its arm 68 and return to its full north position.

10. With the last gate closed, the gate closer tool is retracted from the capstan and the gate closer tool system moves rapidly north to the initial traverse position.

11. The gate opener, gate closer systems, north/south feedback devices go to their home positions.

This invention has been described herein in considerable detail in order to comply with the patent statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

What is claimed is:

1. An automated trackside railcar discharge gate operating system comprising:

(a) a pair of automated carriage-mounted capstan-operating tool systems, comprising a gate-opening tool system and a gate-closing tool system, said tool systems being disposed to travel along a carriage track and open and/or close moving capstan-operated railcar gates, said tool systems including, communication means to acquire and process data, including data regarding capstan coordinates for each car to be processed, a capstan-operating tool and visual device to acquire and track capstans to coordinate tool operation;

(b) a railcar location feedback system comprising a pair of carriage-mounted trackside devices comprising gate-opening and gate-closing feedback devices to coordinate railcar opening and closing operations, respectively, for detecting, being moved by, and communicating the location of railcars to be processed, said devices being disposed to travel along a feedback track and communicate with said at least one fixed camera device for providing railcar location to said fixed-position camera devices; and (c) at least one, fixed-position camera device in communication with said feedback system and said tool systems for sequentially acquiring, processing and transmitting information regarding passing railcars including railcar locations and identity information regarding each car and coordinates of passing gate capstans to coordinate automated opening/closing operation of said tool systems.

2. An automated system as in claim 1 wherein each of said visual devices of said tool systems includes a video camera with three-dimensional capability for recognizing a capstan rotational position and lateral distance position and transmitting information enabling said tool system to track said capstan.

3. An automated system as in claim 1 wherein said tool systems include means for aligning a corresponding capstan operating tool with a recognized capstan rotational orientation.

4. An automated system as in claim 1 wherein each of said feedback devices includes a deployable bogey frame engaging arm and is designed to be pushed along by a railcar after said arm engages a bogey frame of the railcar.

5. An automated system as in claim 1 further comprising a pair of spaced, fixed position cameras to coordinate information for opening and closing capstans, respectively.

6. An automated system as in claim 1 wherein each of said tool systems further comprises a hydraulic power unit that powers both linear travel and operates said capstan operating tool.

7. An automated system as in claim 4 wherein each of said feedback devices is optionally self-propelled along said feedback track.

* * * * *